US005320195A

United States Patent [19]

Reece et al.

[11] Patent Number: 5,320,195

[45] Date of Patent: Jun. 14, 1994

[54] RESCUE CHUTE

[75] Inventors: Norman L. Reece, Boulder, Colo.; Loren K. Hubbell, Johnson County, Kans.; Kenneth M. Farris, Kansas City, Mo.

[73] Assignee: Evac Systems, Inc., Prairie Village, Kans.

[21] Appl. No.: 999,613

[22] Filed: Dec. 31, 1992

[51] Int. Cl.[5] ..... A62B 1/20

[52] U.S. Cl. ..... 182/48; 182/47; 182/129

[58] Field of Search ..... 182/48, 47, 49, 129; 193/25 R, 25 B; 248/231.4, 231.5

[56] References Cited

U.S. PATENT DOCUMENTS

| | | | |
|---|---|---|---|
| 22,324 | 12/1858 | Withers . | |
| 27,992 | 4/1860 | Lippmann . | |
| 113,958 | 4/1871 | Witmer . | |
| 132,073 | 10/1872 | Herold . | |
| 179,525 | 7/1876 | Crockett . | |
| 201,455 | 3/1878 | Sheldon . | |
| 208,944 | 10/1878 | Wohlmann . | |
| 236,348 | 1/1881 | Mickey . | |
| 262,337 | 8/1882 | Wilson . | |
| 263,952 | 9/1882 | Penn | 182/48 X |
| 268,608 | 12/1882 | Bentley . | |
| 275,083 | 4/1883 | Schuett . | |
| 277,049 | 5/1883 | Mickey . | |
| 279,175 | 6/1883 | Meyer . | |
| 291,319 | 1/1884 | Fischer . | |
| 295,278 | 3/1884 | Poole . | |
| 313,024 | 2/1885 | Putnam . | |
| 318,299 | 5/1885 | Samper . | |
| 355,994 | 1/1887 | Horwitz | 182/48 X |
| 383,491 | 5/1888 | Reimers . | |
| 441,082 | 11/1890 | Waldner | 187/48 X |
| 482,274 | 9/1892 | Pride . | |
| 626,277 | 6/1899 | Hegstad . | |
| 720,519 | 2/1903 | Haswell . | |
| 771,648 | 10/1904 | Lamborn . | |
| 775,158 | 11/1904 | Wenig . | |
| 825,994 | 7/1906 | Wenig . | |
| 913,117 | 2/1909 | Feyma . | |
| 1,015,937 | 1/1912 | Brevetti et al. . | |

(List continued on next page.)

OTHER PUBLICATIONS

Portions of the documents listed in this section throughout PTO-1449: File Wrapper of U.S. Pat. No. 4,778,031 File Wrapper of U.S. Pat. No. 4,099,595.

(List continued on next page.)

*Primary Examiner*—Alvin C. Chin-Shue
*Attorney, Agent, or Firm*—David M. Klein

[57] ABSTRACT

A rescue chute suitable for attachment to a fixed structure or to an aerial ladder is disclosed. The chute has two concentric fabric chutes (2,4) supported by a multipurpose mounting bracket (6). The chutes (2, 4) are made of a heat-resistant material. The outer chute has guying rings (8) along its length and is closed with snap hook-and-ring closures (14). The inner chute (4) has a zipper (18) running the entire length of the chute. Zipper-stops and zipper-pulls allow the inner chute to be opened at the different points to allow people to exit the chute. A snap hook (20) at the end of each zipper (18) ensures that the zipper remains closed as the chute is used. An elastic panel (24) runs the entire length of the chute. The elastic (104) may be sandwiched to protect it from heat. The rescue chute includes a non-abrasive entry flap (26). The multipurpose bracket (6) is adaptable to support the chute on a building wall or on an aerial ladder. The bracket (6) is made of coated tubular aluminum and includes an adjustable clamp (34–40) for securing the rescue chute to a wall or balcony. To secure the rescue chute to an aerial ladder, clamp arms (48) and a leveling arm (50) are provided. A metal spoked adjusting wheel (52) allows the rescue chute to be leveled. Hook clamps (58) are used to grasp the ladder rungs. The chutes (2) and (4) are secured to the multi-purpose bracket by means of grommets, reinforced nylon webbing, bolts, and aluminum strips.

31 Claims, 5 Drawing Sheets

U.S. PATENT DOCUMENTS

| | | | |
|---|---|---|---|
| 1,936,195 | 11/1933 | Honig . | |
| 2,101,284 | 12/1937 | Simpson . | |
| 2,270,437 | 1/1942 | Herendeen . | |
| 2,946,396 | 7/1960 | McDougal . | |
| 2,973,112 | 2/1961 | Young . | |
| 3,027,966 | 4/1962 | Johnson et al. . | |
| 3,141,257 | 7/1964 | Stull | 248/231.7 X |
| 3,182,827 | 5/1965 | Frost . | |
| 3,348,630 | 10/1967 | Yamamoto . | |
| 3,910,377 | 10/1975 | Zamorski . | |
| 3,973,644 | 8/1976 | Zephinie . | |
| 3,994,366 | 11/1976 | Okuma et al. . | |
| 4,005,762 | 2/1977 | Zephinie . | |
| 4,099,595 | 7/1978 | Tracy | 182/48 |
| 4,099,596 | 7/1978 | Tracy . | |
| 4,162,717 | 7/1979 | Orii et al. . | |
| 4,167,224 | 9/1979 | Kinase et al. . | |
| 4,240,520 | 12/1980 | LaGrone et al. . | |
| 4,261,434 | 4/1981 | Mitchell . | |
| 4,262,772 | 4/1981 | Richardson . | |
| 4,339,019 | 7/1982 | Tracy . | |
| 4,341,286 | 7/1982 | Gregory . | |
| 4,369,538 | 1/1983 | Smedal . | |
| 4,372,423 | 2/1983 | Pelley . | |
| 4,398,621 | 8/1983 | Baker . | |
| 4,577,725 | 3/1986 | Hunter . | |
| 4,589,519 | 5/1986 | Hunter . | |
| 4,595,074 | 6/1986 | Nordtvedt . | |
| 4,650,034 | 3/1987 | D'Avanzo . | |
| 4,681,186 | 7/1987 | Leisman et al. | 182/48 X |
| 4,778,031 | 10/1988 | Curiel . | |
| 4,888,941 | 12/1989 | Gerber . | |
| 5,115,885 | 5/1992 | Chouest . | |

OTHER PUBLICATIONS

*Slide to Safety Fire Chiefs Try Out Evacuation Chute,* Detroit Free Press, (Feb. 10, 1989).

*Company Fired up About Safety Chute South Florida's High Rises Lure Evac Systems,* Sun Sentinel (Aug. 6, 1990).

*Firm Burned Up Over Fire Escape Chute,* Globe & Mail (Toronto Canada)(Dec. 16, 1986).

*New Thermal-Resistant Rescue Chute Uses "Kevlar",* News Release (Sep. 21, 1988).

*Rescue Chute Controls Descent Rate,* Design News (Feb. 27, 1989).

*Texan Invents Fire Rescue Basket,* UPI (Jun. 30, 1981).

*Japanese Fire Escape Devices Sold By Pine Bluff Businessman,* UPI (Feb. 28, 1982).

*Emergency Chute Launched,* The Financial Times Limited; Financial Times (Jan. 14, 1986).

*Escape Chute Developed for Platforms,* Oil & Gas Journal, (May 18, 1987).

*A Net Plus for Safety, Ralph Baker's Life Chute May Save Lives in High-Rise Fires,* People (Jul. 13, 1987).

*Emergency Escape Chute,* Offshore (Nov. 1987).

*The Baker Life Chute to Make First Public Demonstration in Michigan,* PR Newswire Association, Inc. (Feb. 8, 1989).

*The Contingency Plans for Emergencies,* Newsday (Sep. 27, 1988).

FIG. 2
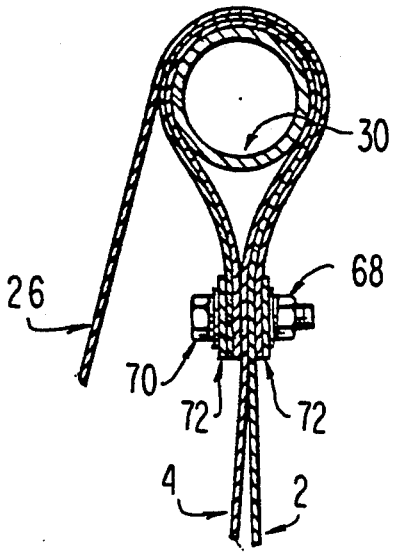
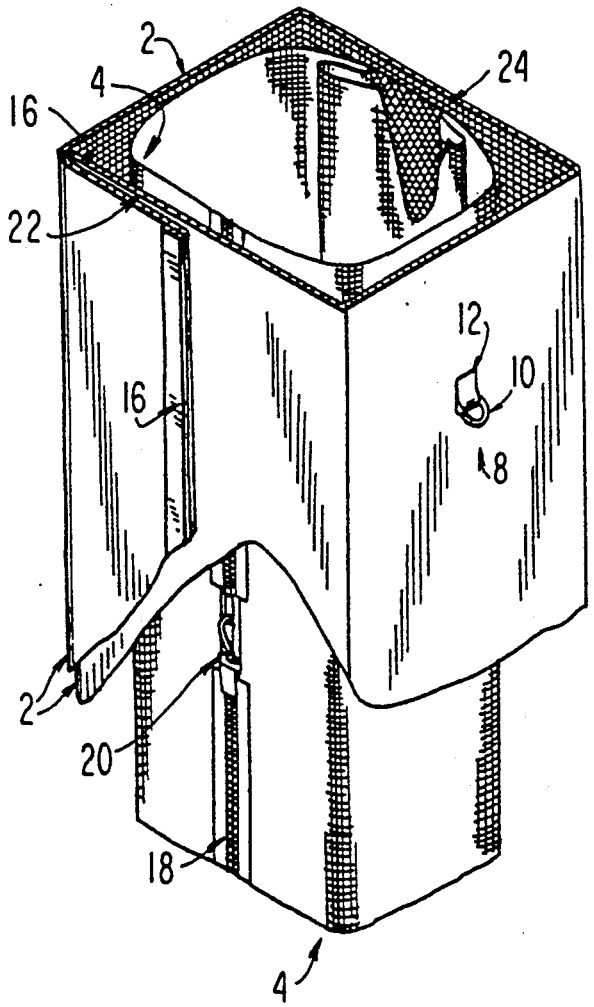
FIG. 3

FIG. 4
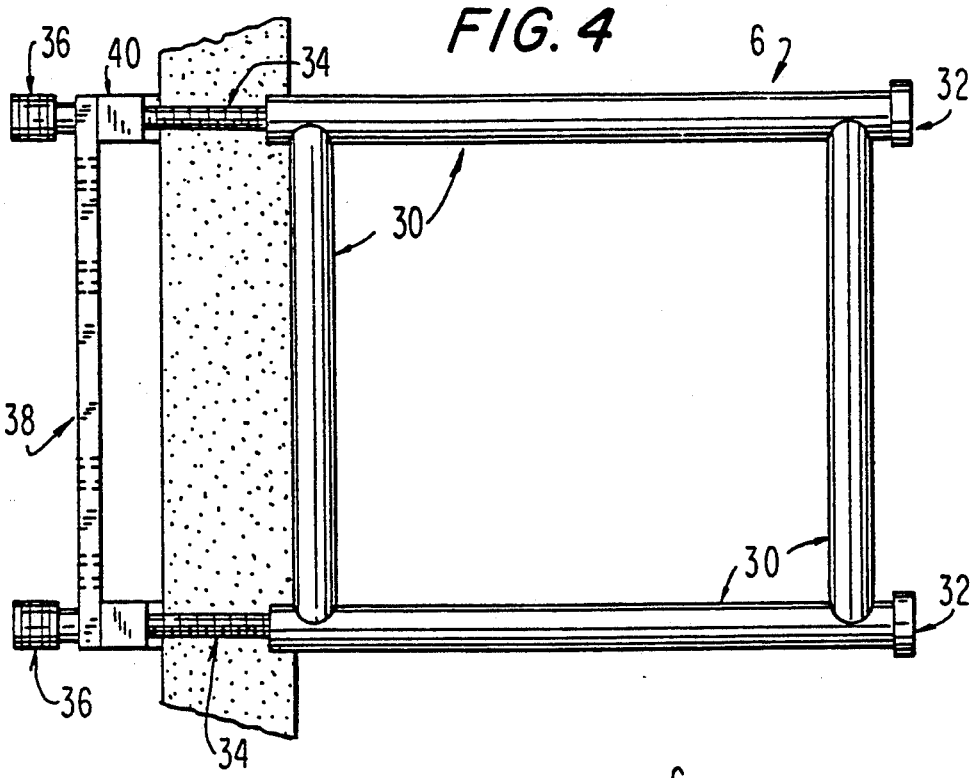
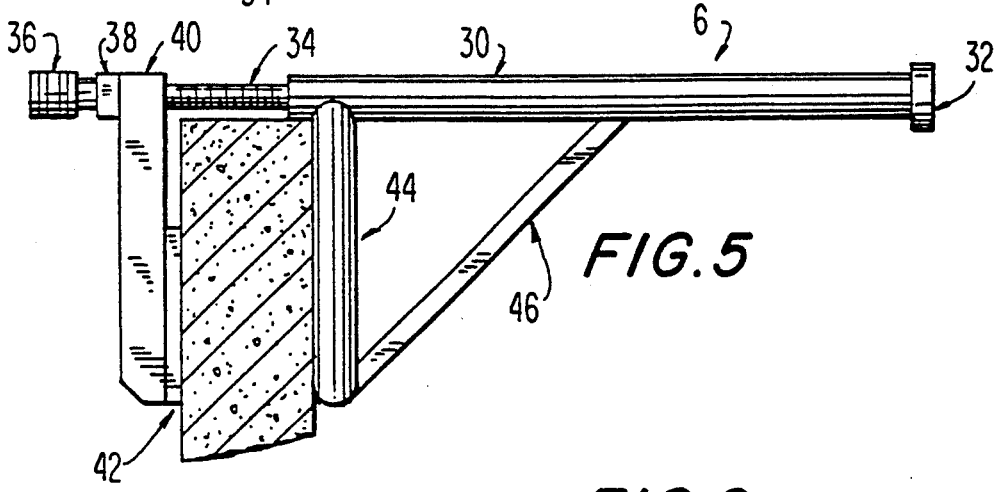
FIG. 5
FIG. 6
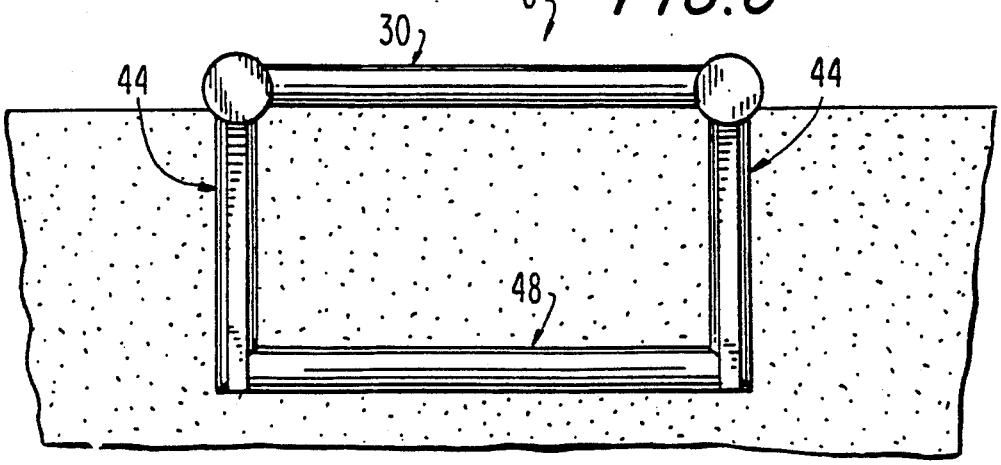

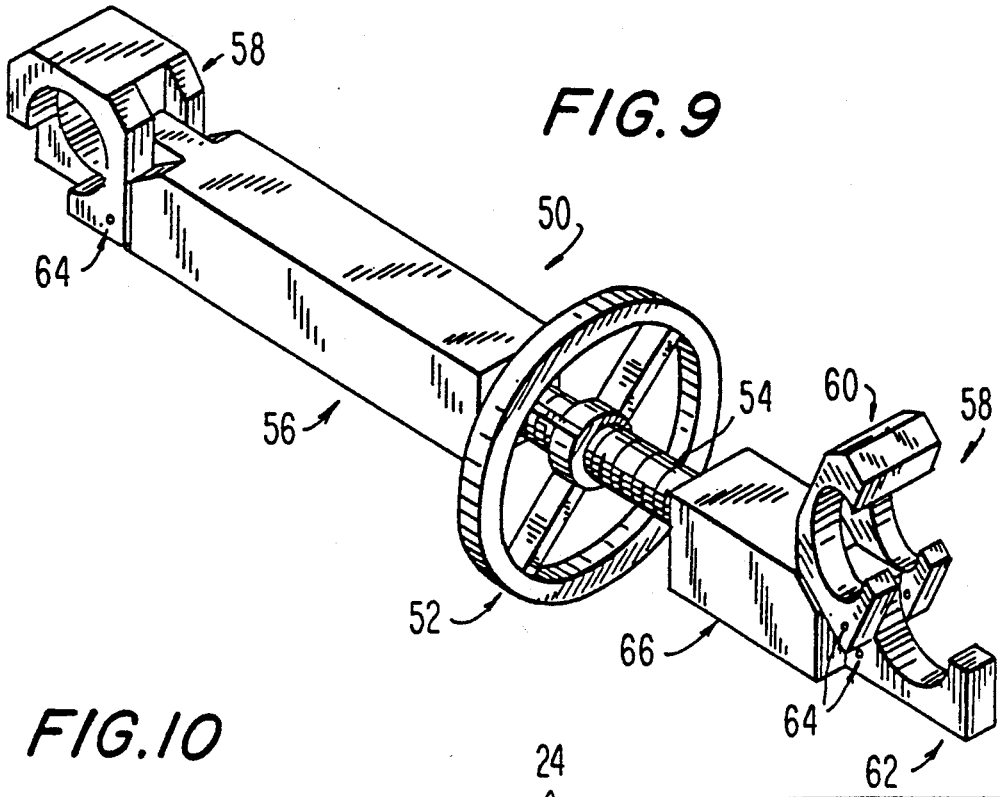
FIG. 9
FIG. 10
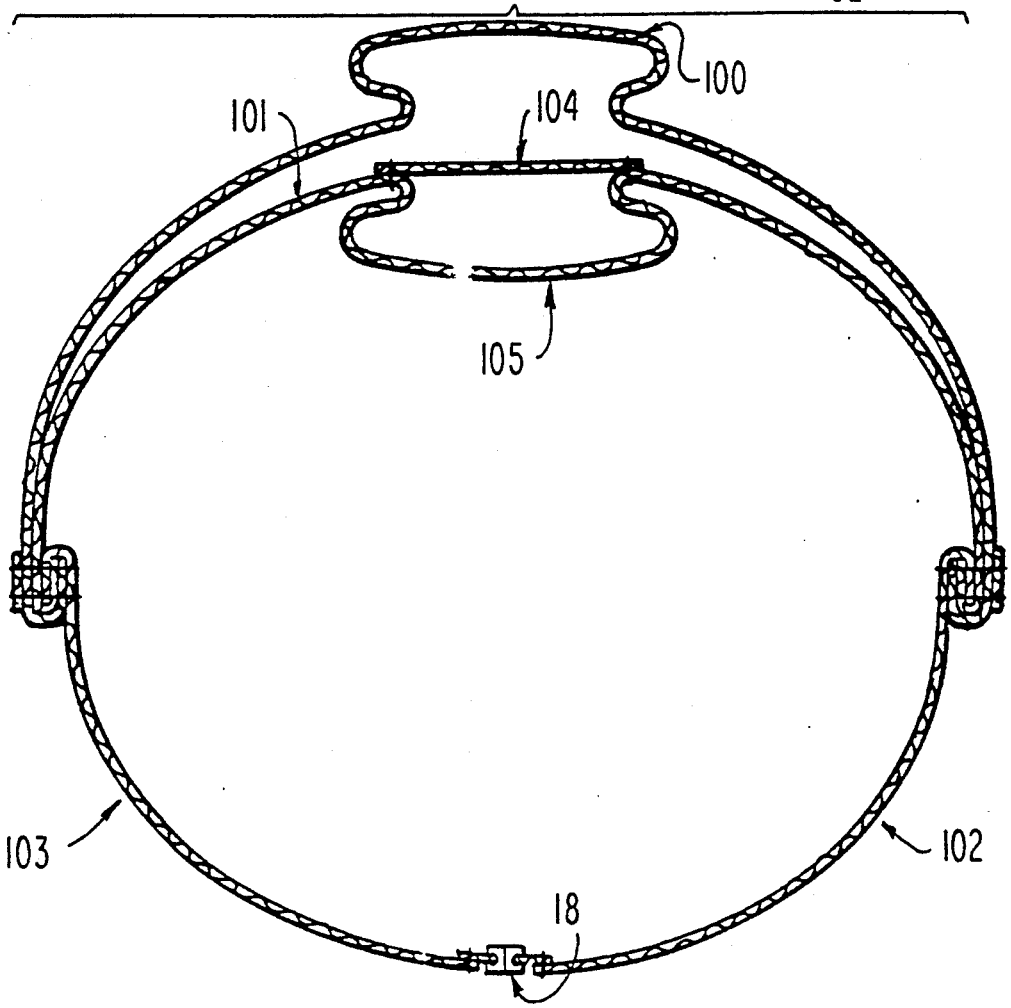

RESCUE CHUTE

BACKGROUND OF THE INVENTION

1. Field of the Invention

The present invention relates generally to evacuation chutes, and more particularly to an evacuation chute having a bracket suitable for mounting on a building or an aerial ladder, and which is usable at any height up to the full length of the chute.

2. Description of the Prior Art

Chutes to enable persons to escape from multi-story buildings are known in the art.

Tracy, U.S. Pat. No. 4,099,595 shows an escape chute having a frame mountable on a window edge or on a cherry picker. Elastic bands are provided for cushioning the descent of a person passing through the chute, and a mechanism is provided for retracting the chute.

Curiel, U.S. Pat. No. 4,778,031 discloses an escape chute having inner and outer chutes to provide additional heat protection. The inner chute includes an elastic band to slow the rate of descent through the chute.

Leisman, U.S. Pat. No. 4,681,186 discloses a tubular escape chute having a zipper running lengthwise along the tube to allow entry into or exit from the chute at different elevations. The chute may have inner and outer chutes, and may include elastic in the inner chute to slow the rate of descent.

Tracy, U.S. Pat. No. 4,339,019 discloses a foldable emergency chute which is raised and lowered on a crane apparatus.

Other examples of safety chutes are shown in, for example, U.S. Pat. Nos. 4,398,621, 4,595,074, 22,324, 3,027,996, 179,525, 27,992, 113,958, 132,073, 3,910,377.

None of these references provide a rescue chute which is adaptable for securing a rescue chute to a fixed structure, such as a building wall, and to an aerial ladder. Furthermore, none of these references disclose a rescue chute for attachment to an aerial ladder which is adjustable to level the chute at varying angles, and which is suitable for easy installation and removal.

SUMMARY OF THE INVENTION

The rescue chute of the present invention is a versatile escape device intended for use by fire and other emergency professionals. It functions as a uniquely fast and safe method of evacuating elevated structures under emergency conditions. It is especially useful for removing disabled, elderly and unconscious people. The rescue chute is suitable for attachment to either a building wall or window sill, or to a fire rescue ladder.

The rescue chute includes two concentric tube-shaped fabric chutes supported by a unique multi-purpose mounting bracket. The outer chute is made of a heat-resistant material such as Gentex® and protects the inner chute and escaping people from heat and flames. The rescue chute may be used to lengths of more than 200 feet.

To stabilize the chute, the outer chute is equipped with guying rings at intervals along its length. At the mounting point for the guying rings, the outer chute material is reinforced with laminated nylon material.

The outer chute is equipped with snap hook-and-ring closures at intervals along its length. These ensure that the outer chute encloses the inner chute except at the point at which the chute reaches the ground, at which point the outer chute will be opened to allow people to escape. This allows the present rescue chute to be used to evacuate persons from any height up to the maximum length of the chute. The vertical edges of the outer and inner chutes may be reinforced with nylon webbing.

The inner chute is preferably made of fire retardant coated Cordura® which provides excellent heat resistance, high tensile strength and durability.

The inner chute has a zipper running the entire length of the chute. Zipper-stops and zipper-pulls are placed on the zipper at 7-foot intervals to allow the inner chute to be opened at the appropriate point to allow people to exit the chute at ground level. A snap hook is located at the end of each zipper to ensure that each zipper remains closed as the chute is used.

An elastic panel running the entire length of the chute is provided to allow the inner chute to expand to accommodate larger and smaller users and to assist in moderating the user's rate of descent to a safe speed. In a preferred embodiment, the Spandex® elastic is sandwiched between two sheets of Cordura® to protect it from the heat. The combination of an outer chute of Gentex®, an inner chute of fire retardant coated Cordura® and an air gap between them provides exceptional heat protection.

A non-abrasive entry flap is provided to reduce fear by restricting the length of the inner chute which is visible through the entry point, and to protect both the user and chute.

A multi-purpose bracket is adaptable to support the rescue chute on a fixed structure, such as a building wall, or on an aerial ladder. The bracket is made of coated tubular aluminum and is lightweight. It allows the chute to be installed and removed very quickly without the use of special tools. The multi-purpose bracket is square-shaped and includes elastic bumpers to support the chute against a building in an aerial ladder configuration.

The present invention includes an adjustable clamp for securing the rescue chute to a window sill or balcony. Two screws having knurled handles are threadably inserted into the bracket. As the knurled tightening knobs are rotated, they apply pressure against a clamp bar which applies pressure to downwardly extending clamping blocks. In conjunction with downwardly extending clamping supports, the supporting wall is squeezed between the clamping supports and the clamping blocks to support the rescue chute.

The multi-purpose bracket is also suitable for use on a variable-angle aerial ladder. Clamp arms are provided for grasping a rung of the aerial ladder at one end, and being fixedly attached to the rescue chute at the other end. These allow the bracket to be attached to an aerial ladder quickly and securely. To compensate for the angle of the aerial ladder, a leveling arm attaches as a third connecting point between the aerial ladder and the multi-purpose bracket. A metal spoked adjusting wheel allows the rescue chute to be leveled through the range of angles possible for the aerial ladder.

The clamp arms and leveling arm include hook clamping members for grasping a rung of the ladder. The hook clamping members have C-shaped locking members to close around the rung. A locking pin secures the clamping member to the rung. The locking pin includes a resilient member to prevent the pin from falling out of the clamp.

The inner and outer chutes are securely attached to the multi-purpose bracket, by means of grommets, reinforced nylon webbing, bolts, and an aluminum strip.

These give the chutes excellent support, and reduce the likelihood of a chute tearing.

BRIEF DESCRIPTION OF THE DRAWINGS

FIG. 2 shows a cross-sectional view of the support mechanism of the rescue chute along Section 2—2.

FIG. 3 shows a partial cutaway perspective view through Section 3—3 of the inner and outer chutes of the rescue chute of the present invention.

FIG. 4 shows a top view of the support bracket of the rescue chute of the present invention.

FIG. 5 shows a side view of the support bracket of the rescue chute of the present invention.

FIG. 6 shows a rear view of the support bracket of the rescue chute of the present invention.

FIG. 9 is a perspective view of the leveling arm for the support bracket of the rescue chute of the present invention.

FIG. 10 shows an embodiment of the inner chute of the rescue chute of the present invention.

DESCRIPTION OF THE PREFERRED EMBODIMENT

Figure 1:
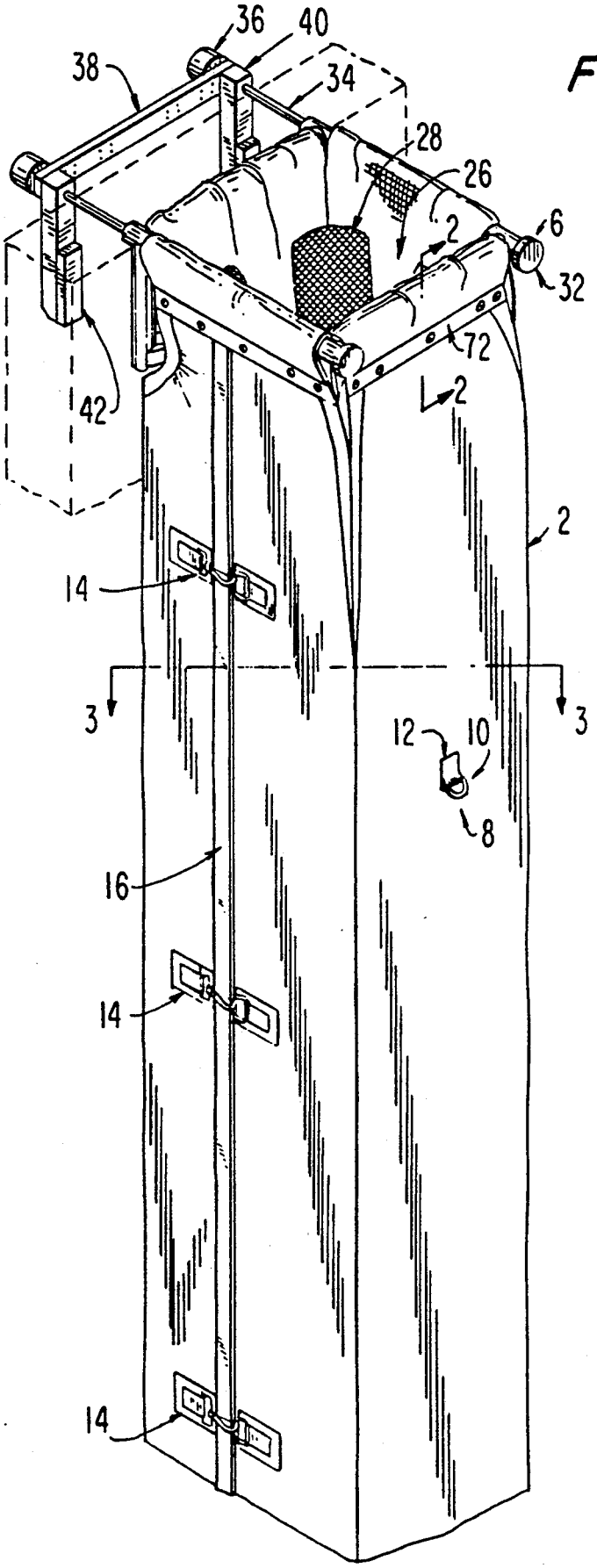
FIG. 1 shows a perspective view of the mounting bracket and rescue chute of the present invention.

As shown in FIGS. 1 and 3, the present invention is a rescue chute suitable for attachment to either a building wall or window sill, or to a fire rescue ladder. The rescue chute includes two concentric tube-shaped fabric chutes, outer chute 2 and inner chute 4, supported by mounting bracket 6.

The outer chute 2 is preferably made of a heat-resistant material such as Gentex®. Outer chute 2 protects inner chute 4 and users of the chute from radiant and convected heat. It also provides some protection from smoke, water and other elements.

The present rescue chute may be used to lengths of more than 200 feet. To prevent motion of the chute in windy conditions, or to help stabilize the chute while in use, outer chute 2 is preferably equipped with guying rings 8 located along its sides at intervals along its length. Each guying ring 8 includes a D-shaped link 10 to serve as an attaching point for a rope or other securing means, and a fabric base 12 to secure the D-shaped link 10 to the outer chute 2. At the mounting point on outer chute 2 for the guying ring base 12, the outer chute material is preferably reinforced with a patch of high strength nylon material laminated to the outer chute 8. If desired, a reinforcing patch may be mounted on both the inside and outside of outer chute 2 at the attachment point. The base 12 for guying ring 8 is then preferably sewed to the outer chute 2.

The outer chute 2 is also preferably equipped with snap hook-and-ring closures 14 at intervals along its length. These function to ensure that the outer chute encloses the inner chute except at the point at which the chute reaches the ground. The closures 14 are preferably mounted at 30 inch intervals along the length of outer chute 2. At the point at which the chute reaches the ground, people may be allowed to exit the chute by releasing hook-and-ring closure 14 at that point to open outer chute 2, and opening inner chute 4 at the same point, as described below. This allows the rescue chute to be used to evacuate persons from any height up to the maximum length of the chute. Snap hook-and-ring closures 14 are preferably conventionally sewed to outer chute 2. Outer chute 2 may be reinforced at the attachment points for snap hook-and-ring closures 14 with laminated nylon, as previously described. Snap hook-and-ring closures 14 are positioned on outer chute 2 so as to allow an area of overlap 22 of the outer chute, preferably 10 inches.

In a preferred embodiment, the vertical edges 16 of outer chute 2 are preferably reinforced. This is done by first folding the edge of the material a small distance, preferably less than an inch, inward along the entire length of the edge. A nylon strip, preferably 2 inches wide, is then preferably folded around the edge and sewed into place. This method has been found to provide added strength to the vertical edges 16 of outer chute 2, and helps to improve durability of the chute. It is readily foreseen that other methods of strengthening the edges may be used.

Inner chute 4 is equipped with a zipper 18 running the entire length of the chute. Zipper 18 is preferably conventionally sewed to the vertical edges of inner chute 4. If desired, the edge of zipper 18 may be rolled with the edges of inner chute 4 and reinforced with nylon webbing before being sewed to add extra strength to the seam.

Zipper-stops and zipper-pulls are preferably placed on the zipper 18 at 7-foot intervals. These allow 7-foot sections of the inner chute 4 to be opened individually as necessary. For example, if a 200 foot chute is in use, and people are being evacuated from a height of 100 feet, the inner chute zipper 18, and the outer chute snap hook-and-ring closure 14 may be opened at the appropriate point to allow people to exit the chute at ground level. A snap hook 20 is located at the end of each zipper to ensure that each zipper remains closed as the chute is used.

Zipper 18 preferably has nylon-coated metal teeth and polyester taping. It is readily foreseen that any conventional zipper or other fastener may be used to close inner chute 4.

Both inner chute 4 and outer chute 2 are preferably open at their bottoms. It is foreseen that all seams and edges of the chute may be reinforced with nylon webbing, if desired.

The inner and outer chute are preferably concentric throughout their lengths, with an air gap between them. An elastic panel 24 is provided to allow the inner chute 4 to expand as necessary, both to accommodate larger and smaller users and to assist in moderating the user's rate of descent to a safe speed. Elastic panel 24 preferably runs the entire length of the inner chute. It is attached to the inner chute 4 so that it gathers the inner chute into a pleat.

As shown in FIG. 10, in a preferred embodiment, the inner chute is constructed of 4 sheets of Cordura® 100–103 and a strip of Spandex® elastic 104. The edges of the Spandex® are preferably sewed lengthwise onto one of the sheets of Cordura® 101 several inches in from the edges of the Cordura® sheet. This forms the Cordura® into a pleat 105. The vertical edges of a second sheet of Cordura® 100 are then sewed to the edges of the first sheet 101, sandwiching the Spandex® 104 to protect it from heat. The two sheets of Cordura® 100 and 101 are sewed at their edges after having their edges rolled and reinforced by a 2 inch strip of nylon webbing, as previously described. This sandwiched Spandex ® panel forms elastic panel 24.

Each vertical edge of elastic panel 24 is sewed to an edge of the 2 remaining Cordura ® sheets 102 and 103. Each free edge of the remaining Cordura ® sheets is sewed to an edge of zipper 18 to complete the inner chute 4. All of the seams may be rolled and bound with reinforcing material before being sewed, if desired.

In an alternative embodiment, as shown in FIG. 3, a continuous sheet of Cordura ® may be used to form the inner chute 4. In this embodiment, the Spandex ® is just sewed into the Cordura to make a pleat, thereby forming elastic panel 24.

The unique combination of chute materials functions to provide an additional degree of heat resistance beyond those of the materials themselves. Using an outer chute of Gentex ®, and an inner chute of Spandex ® and fire retardant coated Cordura ®, it has been found that the thermodynamic characteristics of the combination are such that when the outer chute is subjected to an external temperature of 1,800° F., the temperature within the chute rises by only 6° F.

A non-abrasive flap 26 made of heat-treated woven nylon is provided at the entrance to the chute. The function of the non-abrasive flap 26 is threefold. First, it protects the users from being injured by contact with the hardware used to attach the chutes. Second, it protects the inner chute from abrasion at the entry point. Third, it reduces users' fear by restricting the length of the inner chute which is visible through the entry point. Non-abrasive flap 26 preferably includes panels of Spandex ® to bias the flap inward to obscure visibility down the chute. Non-abrasive flap 26 preferably extends only a few feet down the chute.

If desired, the chute may also include an entry canopy. As people are entering the chute at a high elevation, they would ordinarily be able to see around the chute to the ground and the surroundings. A canopy frame is preferably mounted on and above bracket 6. The canopy frame secures a fabric canopy around the chute opening, and limits visibility while entering the chute. A dividing entry curtain is opened to allow people to enter the chute.

As people are being evacuated through the chute, it has been found that some are apprehensive because they do not know when they are about to reach the ground. If desired, tactile safety warning means may be provided inside the inner chute to inform evacuees of their present location. For example, one or more Velcro ® or other abrasive strips may be installed circumferentially inside the chute 10 or 15 feet above the exit of the chute. Evacuees will feel the Velcro ®, or other abrasive fabric, and be aware of their location. It is foreseen that other less practical safety warnings, such as an audible warning, are possible.

A multi-purpose bracket 6 is provided which is adaptable to support the present rescue chute on a fixed structure, such as a building wall, or on an aerial ladder. Multi-purpose bracket 6 is preferably made of tubular aluminum which functions to support the chute securely in a wide variety of situations, and is relatively lightweight. It also functions to allow the chute to be installed and removed very quickly without the use of special tools.

As shown in FIG. 4, multi-purpose bracket 6 includes four tubular member 30 which are fixedly attached at their ends to form a square-shaped support for the rescue chute. Butting the ends of two of the tubular members 30 are elastic bumpers 32. These are preferably made of rubber or other elastic material. When the rescue chute is being used on an aerial ladder, these allow the chute to be butted against a building, thereby making the rescue chute significantly more stable in use.

As shown in FIGS. 4–6, multi-purpose bracket 6 may be configured to mount the present rescue chute on a fixed-position structure such a window sill or balcony. Two screws 34 are threadably insertable in two of the tubular arms 30. Screws 34 are preferably made of stainless steel and have knurled tightening knobs 36 on one end, the other end being screwed into tubular arm 30. Knurled tightening knobs 30 allow the clamp to be tightened quickly and securely without the aid of additional tools. As knurled tightening knobs 30 are rotated, they apply pressure against clamp bar 38 which applies pressure to downwardly extending clamping blocks 40. Clamping blocks 40 preferably include urethane pads 42 which butt the wall which will support the chute.

On the other side of the support wall, reinforced downwardly extending clamping supports 44 are provided. These are reinforced by reinforcement bars 46. As knurled knobs 30 are tightened, the supporting wall is squeezed between clamping supports 44 and clamping blocks 40. When knurled knobs 30 are loosened, the rescue chute is released from the wall.

Figure 7:
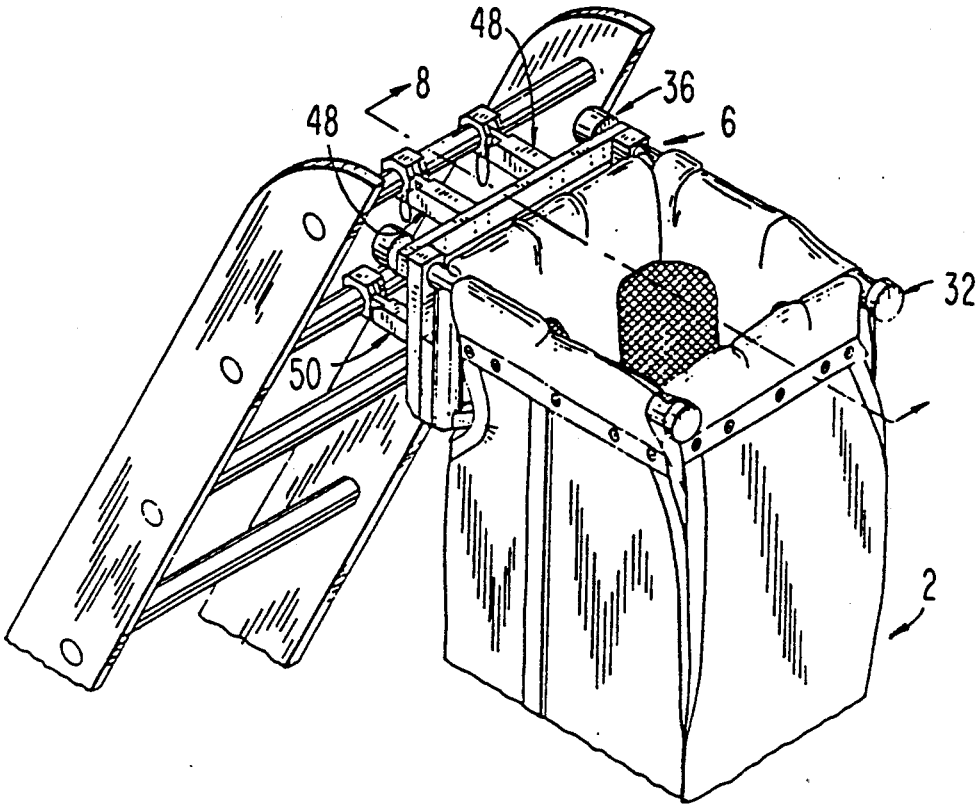
FIG. 7 shows a perspective view of the rescue chute of the present invention mounted on a rescue ladder.
Figure 8:
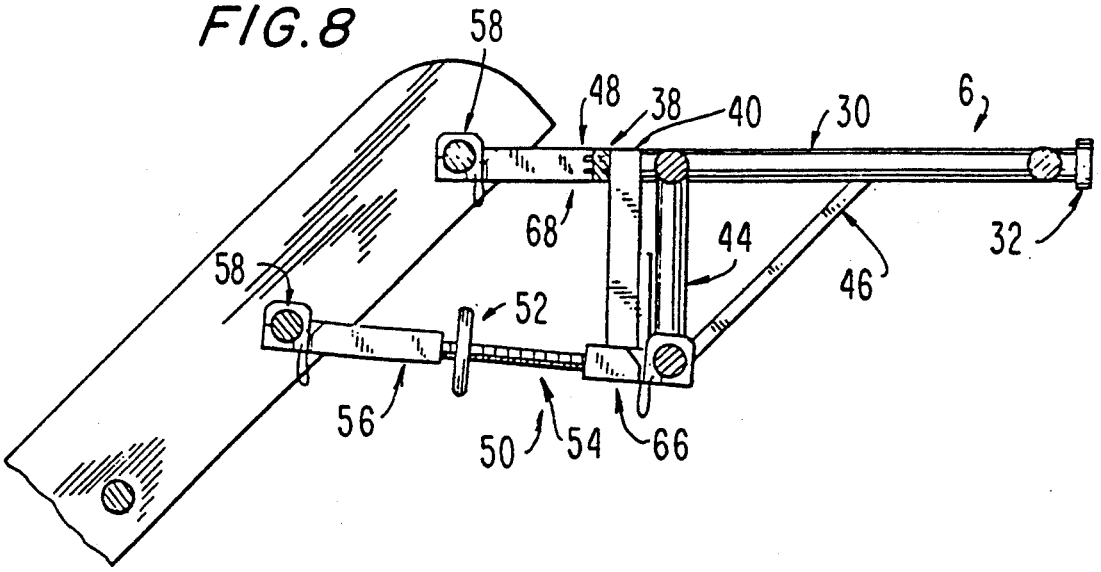
FIG. 8 shows a cross-sectional side view through Section 8—8 of the support bracket of the rescue chute of the present invention mounted on a rescue ladder.

As shown in FIGS. 7–9, multi-purpose bracket 6 is also suitable for use on a variable-angle aerial ladder. Clamp arms 48 are provided for grasping a rung of the aerial ladder at one end, and being fixedly attached to clamp bar 38 at the other end. These function to allow the bracket to be attached to aerial ladders quickly and securely. Each clamp arm 48 includes a base member 68 which is attached to clamp bar 38 such as by stainless steel screws.

To compensate for the angle of the aerial ladder, leveling arm 50 attaches as a third connecting point between the aerial ladder and multi-purpose bracket 6. The leveling arm 50 attaches between the horizontal support rung 48 of the multi-purpose mounting bracket 6 and a rung of the aerial ladder.

Each of the clamp arms 48 and leveling arm 50 includes a hook clamping member 58 for grasping a rung of the ladder. Each hook clamping member 58 includes C-shaped locking member 60 and lock base 62. On each clamp arm 48, clamp base 68 preferably is integral with lock base 62. In use, a rung is inserted into the clamp, and C-shaped locking member 60 is closed around the rung. A locking pin is preferably then inserted through hole 64 to securely lock the clamping member 58 to the rung. The locking pins ensure that the clamps cannot release unexpectedly while still allowing the clamps to be released quickly when desired. The locking pin includes a resilient member to prevent the pin from falling out of hole 64 while the clamping member is in use. This resilient member is preferably a spring biased ball recessed in the locking pin.

As shown in FIG. 9, leveling arm 50 includes short base 66 and long base 56, preferably constructed of aluminum. Each of these bases 56 and 66 preferably are integral with the lock base 62 of their respective C-clamps. Each base 56 and 66 is preferably drilled out to form a hole to allow threaded adjusting post 54 to be freely movable therein. After threaded adjusting post 54 has been inserted in each hole, the ends of the holes are capped to allow free movement of threaded adjusting post 54 in the hole, but to prevent threaded adjusting post 54 from being removed from the hole.

A metal spoked adjusting wheel 52 is provided for varying the effective length of leveling arm 50 and thus functions to level the multi-purpose bracket 6 through the range of angles possible for an aerial ladder. By allowing free movement of adjusting post 54 in the hole of long base 56, the chute may be quickly adjusted to the proper angle. The bracket is lifted by a fireman to the correct angle, and then metal spoked adjusting wheel 52 is spun to the correct position to support the bracket.

It is foreseen that adjusting post 54 may be threaded into long base 56 and that adjusting wheel 52 may be fixed to post 54 to provide the same leveling function as described. However, the preferred embodiment described above allows the rescue chute to be deployed and stowed faster than previously possible.

Multi-purpose bracket 6 and support arms 48 and 50 are preferably constructed of coated aluminum. The attachment hardware, i.e. bolts, nuts, and adjusting post 54 are preferably made of stainless steel. It is foreseen that other high strength, lightweight, water-resistant, and corrosion-resistant materials may be used in the various parts of the present invention.

As shown in FIGS. 1 and 2, the fabric chutes 2 and 4, and non-abrasive flap 26 are securely attached to the load-bearing tubular members 30 of multi-purpose bracket 6. As shown in FIG. 2, the inner and outer chutes 2 and 4 may be brought over the tubular members 30 and back down to a point at which the top edges of the chutes ar brought into contact with the inner chute. This occurs preferably 6 inches down form the top of tubular members 30. At the points of contact, i.e. the top edges of each chute, and the point 12 inches down each chute, the chute material is preferably laminated on each side with a reinforcing nylon webbing. Grommets are then inserted through the each layer of chute and reinforcing nylon. Since the outer chute 2 is wider than the inner chute 4, the outer chute 2 will preferably be supported by 5 bolts, so the outer chute 2 will have 5 grommet holes located 12 inches down, and 5 grommet holes near the top edge. These grommet holes preferably line up when the outer chute 2 is brought down over tubular members 30.

Inner chute 4 preferably has 3 grommet holes near its top edge and 3 aligned grommet holes at about 12 inches down form the top edge. These 3 holes preferably line up with the 3 center holes of the 5 holes in the outer chute 2. A strip of reinforcing aluminum is preferably placed between the two layers of chutes at their connection point to add strength. The reinforcing aluminum strip preferably has pre-drilled holes aligned with the holes in the chutes. Five conventional bolts 70 and nuts 68 on each side are preferably used to secure the chutes to the tubular members 30.

As shown in FIG. 2, two strips of aluminum 72 may also be used to sandwich the layers of chutes, if desired. Also as shown in FIG. 2, non-abrasive flap 26 may be reinforced at its top edge with laminated nylon reinforcement, and have grommets installed, and be secured to tubular members 26 along with the chutes.

It is foreseen that the present invention may be configured with a multi-purpose bracket that is not necessarily square-shaped, although a square or rectangular shape has been found to be the most advantageous. Although the present invention has been described in detail with respect to certain embodiments and examples, variations and modifications exist which are within the scope of the present invention as defined in the following claims.

What is claimed is:

1. A rescue chute for allowing evacuation from a multi-story building comprising:

a bracket for supporting said rescue chute, said bracket comprising a frame member for providing a base for securing said rescue chute; a clamp for securing said frame member to a wall, said clamp comprising a pair of elongate clamp members each having an elongated clamping face disposed in an opposed relationship to the elongated clamping face of the other clamp member one of said clamp members being attached to said frame member; means supporting said clamp members for allowing and away from the other clamp member; clamping means coupled between said clamp members for moving said movable clamp member toward and away from said attached clamp member for gripping said wall between said clamping faces; a clamping arm and a variable length leveling arm for alternatively securing the frame member to a ladder having rungs, each arm having a hook clamp at one end for releasably securing the arm to a rung of a ladder, said clamping arm other end being securely attachable to either said frame member or said clamp, said leveling arm further comprising means for adjusting the length of said leveling arm, said leveling arm other end being securable to either said frame member or said clamp, said leveling arm being lengthened and shortened to level said frame member;

a substantially enclosed flexible inner chute securely attached to said bracket frame member, an opening being formed at the attachment point of said inner chute to said frame member for allowing persons to enter said inner chute through said bracket frame member, said inner chute being open at the bottom; and a substantially enclosed flexible outer chute enclosing said inner chute, said outer chute being securely attached to said bracket frame member at said opening, said outer chute being open at the bottom.

2. The rescue chute according to claim 1 further comprising:

said inner chute further comprising means for opening said inner chute at predetermined points lengthwise on said inner chute for allowing persons to exit said inner and outer chutes;

said outer chute further comprising means for opening said outer chute at predetermined points lengthwise on said outer chute for allowing persons to exit the inner and outer chutes.

3. The rescue chute according to claim 2 wherein said means for opening said inner chute comprises a zipper.

4. The rescue chute according to claim 3 wherein said zipper is oriented lengthwise.

5. The rescue chute according to claim 4 wherein said zipper runs lengthwise along the entire length of said inner chute, said zipper comprising zipper pulls and zipper stoppers at said predetermined points.

6. The rescue chute according to claim 5 further comprising snap hook means for securing each zipper pull to an adjacent zipper stop.

7. The rescue chute according to claim 5 wherein said means for opening said outer chute comprises snap hook-and-ring closure means.

8. The rescue chute according to claim 2 wherein said means for opening said outer chute comprises snap hook-and-ring closure means.

9. The rescue chute according to claim 8 wherein said outer chute further comprises a guying ring fixedly secured to said outer chute.

10. The rescue chute according to claim 1 wherein said inner chute further comprises elastic means running lengthwise on said inner chute, said elastic being secured at its edges to said inner chute to form a pleat of the inner chute material for reducing the circumference of said inner chute and allowing said inner chute to be expandable and contractable around a person traveling through the chute.

11. The rescue chute according to claim 7 wherein said inner chute further comprises elastic means running lengthwise on said inner chute, said elastic means being secured at its edges to said inner chute to form a pleat of the inner chute material for reducing the circumference of said inner chute and allowing said inner chute to be expandable and contractable around a person traveling through the chute.

12. The rescue chute according to claim 8 wherein said inner chute further comprises elastic means running lengthwise on said inner chute, said elastic means being secured at its edges to said inner chute to form a pleat of the inner chute material for reducing the circumference of said inner chute and allowing said inner chute to be expandable and contractable around a person traveling through the chute.

13. The bracket according to claim 1 wherein said means supporting said clamp members for allowing movement of one of said elongate clamp members and said clamping means coupled between said clamp members comprises bolt means threadable in said frame member, said bolt being movable toward and away from said attached clamp member responsive to rotations of said bolt, said movable clamp member being movable with a non-threaded end of said bolt, said non-threaded end further comprising handle means for turning said bolt means, said clamp being tightened and loosened by clockwise and counterclockwise rotations of said handle.

14. The rescue chute according to claim 13 further comprising:

said inner chute further comprising means for opening said inner chute at predetermined points lengthwise on said inner chute for allowing persons to exit said inner and outer chutes;

said outer chute further comprising means for opening said outer chute at predetermined points lengthwise on said outer chute for allowing persons to exit the inner and outer chutes.

15. The rescue chute according to claim 14 wherein said means for opening said inner chute comprises a zipper running lengthwise along the entire length of said inner chute, said zipper comprising zipper pulls and zipper stoppers at said predetermined points.

16. The rescue chute according to claim 15 wherein said means for opening said outer chute comprises snap hook-and-ring closure means.

17. The rescue chute according to claim 14 wherein said means for opening said outer chute comprises snap hook-and-ring closure means.

18. The rescue chute according to claim 1 wherein said outer chute material comprises Gentex® and wherein said inner chute material comprises fire retardant coated Cordura®.

19. A bracket for supporting a rescue chute which comprises:

a frame member for providing a base for securing said rescue chute;

a clamp for securing said frame member to a wall, said clamp comprising a pair of elongate clamp members each having an elongated clamping face disposed in an opposed relationship to the elongated clamping face of the other clamp member, one of said clamp members being attached to said frame member;

means supporting said clamp members for allowing movement of one of said elongate clamp members generally towards and away from the other clamp member;

clamping means coupled between said clamp members for moving said movable clamp member toward and away from said attached clamp member for gripping said wall between said clamping faces;

a clamping arm and a variable length leveling arm for alternatively securing the frame member to a ladder having rungs, each arm having a hook clamp at one end for releasably securing the arm to a rung of a ladder, said clamping arm other end being securely attachable to either said frame member or said clamp, said leveling arm further comprising means for adjusting the length of said leveling arm, said leveling arm other end being securable to either said frame member or said clamp, said leveling arm being lengthened and shortened to level said frame member.

20. The bracket according to claim 19 wherein said means supporting said clamp members for allowing movement of one of said elongate clamp members and said clamping means coupled between said clamp members comprises bolt means threadable in said frame member, said bolt being movable toward and away from said attached clamp member responsive to rotations of said bolt, said movable clamp member being movable with a non-threaded end of said bolt, said non-threaded end further comprising handle means for turning said bolt means, said clamp being tightened and loosened by clockwise and counterclockwise rotations of said handle.

21. The rescue chute according to claim 19 wherein said outer chute material comprises Gentex® and wherein said inner chute material comprises fire retardant coated Cordura®.

22. The rescue chute according to claim 19 further comprising a substantially enclosed flexible inner chute securely attached to said bracket frame member, an opening being formed at the attachment point of said inner chute to said frame member for allowing persons to enter said inner chute through said bracket frame member, said inner chute being open at the bottom, said inner chute further comprising zipper means for opening said inner chute at predetermined points lengthwise on said inner chute for allowing persons to exit said inner chute said zipper means running lengthwise along the entire length of said inner chute, said zipper means further comprising zipper pulls and zipper stoppers at said predetermined points; and a substantially enclosed flexible outer chute enclosing said inner chute, said outer chute being securely attached to said bracket frame member at said opening, said outer chute being open at the bottom, said outer chute further comprising means for opening said outer chute at predetermined points lengthwise on said outer chute for allowing persons to exit the inner and outer chutes.

23. The rescue chute according to claim 22 further comprising snap hook means for securing each zipper pull to an adjacent zipper stop.

24. The rescue chute according to claim 23 wherein said means for opening said outer chute comprises snap hook-and-ring closure means.

25. The rescue chute according to claim 22 wherein said means for opening said outer chute comprises snap hook-and-ring closure means.

26. The rescue chute according to claim 25 wherein said outer chute further comprises a guying ring fixedly secured to said outer chute.

27. The rescue chute according to claim 22 wherein said inner chute further comprises elastic means running lengthwise on said inner chute, said elastic means being secured at its edges to said inner chute to form a pleat of the inner chute material for reducing the circumference of said inner chute and allowing said inner chute to be expandable and contractable around a person traveling through the chute.

28. The rescue chute according to claim 25 wherein said inner chute further comprises elastic means running lengthwise on said inner chute, said elastic means being secured at its edges to said inner chute to form a pleat of the inner chute material for reducing the circumference of said inner chute and allowing said inner chute to be expandable and contractable around a person traveling through the chute.

29. The rescue chute according to claim 24 wherein said inner chute further comprises elastic means running lengthwise on said inner chute, said elastic means being secured at its edges to said inner chute to form a pleat of the inner chute material for reducing the circumference of said inner chute and allowing said inner chute to be expandable and contractable around a person traveling through the chute.

30. The rescue chute according to claim 22 wherein said outer chute material comprises Gentex® and wherein said inner chute material comprises fire retardant coated Cordura®.

31. The rescue chute according to claim 22 wherein said bracket for securing said rescue chute being alternatively attachable to an aerial ladder or a wall.

* * * * *

UNITED STATES PATENT AND TRADEMARK OFFICE
CERTIFICATE OF CORRECTION

PATENT NO. : 5,320,195

DATED : June 14, 1994

INVENTOR(S): Norman L. Reece et al.

It is certified that error appears in the above-identified patent and that said Letters Patent is hereby corrected as shown below:

Column 8,
Claim 1, Line 13, insert --,-- after "member"
Column 8,
Claim 1, Line 15, insert --movement of one of said elongate clamp members generally towards-- after "allowing"
Column 10,
Claim 10, Line 9, insert --means-- after "elastic"

Signed and Sealed this

Eighteenth Day of October, 1994

*Attest:*

*Attesting Officer*

Bruce Lehman

BRUCE LEHMAN

*Commissioner of Patents and Trademarks*